US005746564A

United States Patent [19]

McPherson

[11] Patent Number: 5,746,564

[45] Date of Patent: May 5, 1998

[54] LIFT TRUCK SIDE LOADING ATTACHMENT

[76] Inventor: Raymond Willard McPherson, 1220 Milwaukee Ave., S. Milwaukee, Wis. 53172

[21] Appl. No.: 797,849

[22] Filed: Feb. 10, 1997

[51] Int. Cl.[6] ..... B66F 9/12

[52] U.S. Cl. ..... 414/607; 414/911

[58] Field of Search ..... 414/607, 639–641, 414/662–664, 911

[56] References Cited

U.S. PATENT DOCUMENTS

| | | | |
|---|---|---|---|
| 2,479,023 | 8/1949 | Johnson | 414/607 |
| 3,850,322 | 11/1974 | Miles et al. | 414/607 |
| 3,984,019 | 10/1976 | Brudi et al. | 414/607 |
| 4,129,223 | 12/1978 | Probst | 414/607 |
| 4,160,509 | 7/1979 | Switzer | 414/607 |
| 4,447,186 | 5/1984 | Renfro et al. | 414/607 X |
| 5,056,982 | 10/1991 | Stockham | 414/607 |
| 5,165,840 | 11/1992 | McKinney | 414/607 |
| 5,316,434 | 5/1994 | Martin et al. | 414/607 |
| 5,366,339 | 11/1994 | Gould | 414/607 |
| 5,560,129 | 10/1996 | Rothbart | 414/607 X |

FOREIGN PATENT DOCUMENTS

| | | | |
|---|---|---|---|
| 2578526 | 9/1986 | France | 414/607 |
| 1029290 | 4/1958 | Germany | 414/607 |

*Primary Examiner*—James W. Keenan

*Attorney, Agent, or Firm*—Patent & Trademark Services; Joseph H. McGlynn

[57] ABSTRACT

An attachment to a fork lift consisting of a rectangular frame connected via a hinge mechanism to a hook piece. In use, the frame pieces are slid over the tines of the fork lift, with screws securing the device in position. The hook piece thus extends to the side of the fork lift, and can then be used to carry long cylindrically shaped objects through tight spaces in a conventional fork lift manner. The hinged connection between the hook piece and the frame piece allows easy loading and unloading of the objects.

6 Claims, 1 Drawing Sheet

LIFT TRUCK SIDE LOADING ATTACHMENT

BACKGROUND OF THE INVENTION

This invention relates generally to attachments for fork lifts and, more particularly, to attachments that allow the carrying of objects not normally carried by fork lifts.

DESCRIPTION OF THE PRIOR ART

Numerous inventions relating to fork lift attachments have been proposed in the prior art. Often, they seek to allow fork lifts to be useful in the movement and carriage of large items which are not normally handled by fork lifts.

U.S. Pat. No. 4,160,509 discloses a removable attachment for a powered industrial truck, such as a fork lift, used to open and close freight car doors and the like.

U.S. Pat. No. 5,366,339 discloses a lifting device for polyethylene barrels comprising a pair of arms each having a sleeve for engaging over the fork of a fork lift truck. A cross bar interconnects the arms and is adjustable in length in conjunction with the adjustment of the spacing between the forks of the forklift truck. On the forward end of each end is mounted an acute gripper pivotal about a vertical pin on the respective arm. The gripper comprises a horizontal band having a sharpened upper edge with band curved around a center of the barrel. Each gripper is rotated by a spring in a direction to open forward ends of the gripper to an increased spacing so that the forward ends can be moved forwardly to engage around the barrel and then each gripper pivots about the vertical pin to face the center of the barrel and to engage the barrel under the bead at the upper end of the barrel.

U.S. Pat. No. 3,850,322 discloses a side loading fork lift device adapted to be used with fork lifts of a fork lift truck. The device comprises a pair of parallel fork lifts extending forwardly from a swing arm assembly which can rotate on a platform to the left or right. The platform comprises a pair of parallel sleeves adapted to engage the fork lifts of a truck. The device comprises several safety features such as means to secure the device to the truck, means to secure the swing arm in a rotated position, leg stand on the device, and heels on the fork lifts for preventing any sliding of a load thereon.

U.S. Pat. No. 5,056,982 discloses an apparatus to facilitate the handling of large rolls of paper stock or similar material consisting of two clamping fixtures adapted to be mounted on the tines of a forklift truck and a shaft that passes through the center of large rolls of paper stock or similar material and is also passed through the clamping fixtures.

Most of the prior art have been used to carry large circular items only by inserting a shaft through the center of such an item or by holding the piece in a vertical orientation. There remains a need for an attachment to a forklift which allows the horizontal carrying of cylindrical items with the ease normally associated with forklift use.

SUMMARY OF THE INVENTION

The present invention comprises two attachments to a fork lift consisting of a rectangular frame connected via a hinge mechanism to a pair of hook pieces. In use, the frame piece is slid over the tines of the fork lift, with screws securing the device in position. The hook pieces thus extend to the side of the fork lift, and can then be used to carry long cylindrically shaped objects in a conventional fork lift manner. The hinged connection between the hook pieces and the frame piece allows easy loading and unloading of the objects.

Accordingly, it is an object of this invention to allow for the carriage of long cylindrical objects in close quarters.

It is a further object of this invention that the carriage employ the ease and convenience of fork lifts.

Finally, it is an object of this device that the cylindrical objects to be carried be easily loaded onto and unloaded from the fork lift.

DESCRIPTION OF THE PREFERRED EMBODIMENT

Figure 1:
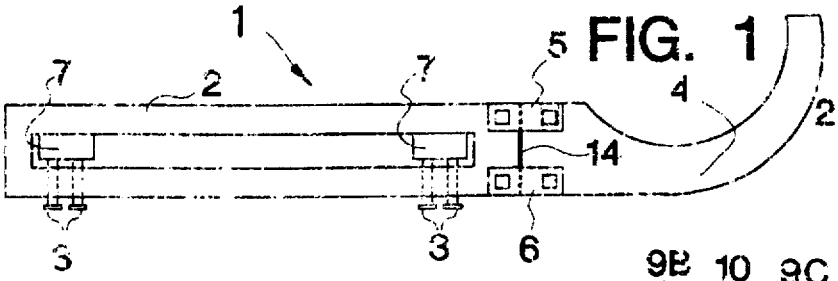
FIG. 1 shows a side view of the device in the locked position.

Referring now to the drawings, there is shown in FIG. 1 the present invention 1 comprising two attachments to a standard fork lift (only one of which is shown in FIG. 1) consisting of a rectangular frame piece 2 connected at one end by an upper hinge mechanism 5 and lower hinge mechanism 6 to a hook piece 4. The interior region of the frame piece 2 is of a length slightly larger than the distance from the outer edges of the tines 7 of a fork lift, and of a height slightly larger than the height of the tines 7, so that the tines 7 of a normal fork lift may be easily slid inside the interior region of the frame piece 2.

Screws 3 are passed through threaded holes in the bottom length of the frame piece 2 so that they apply pressure on the tines 7, thereby securing the tines 7 in position on the interior of the frame piece 2.

The hook piece 4 consists of a semi-circular piece with one flat edge 14 (see also FIG. 6) facing the frame piece 2 and of a height equal to the height of the face of the adjacent frame piece 2. The hook piece 4 is of a thickness which is almost the same as that of the frame piece 2, and has a radius of any length according to the size of the objects to be moved.

Figure 2:
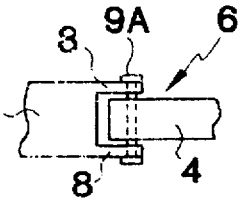
FIG. 2 shows a bottom view of the lower hinge mechanism.

FIG. 2 shows the lower hinge mechanism 6 consisting of protrusions 8 extending from the frame piece 2 over a portion of the hook piece 4. A bolt 9A, or other attachment means, passes through a hole in the protrusion pieces 8 and the hook piece 4 so that the hook piece 4 is attached to the protrusions 8 and, thus, the frame piece 2. Hinge mechanism 6 is welded to frame piece 2.

Figure 3:
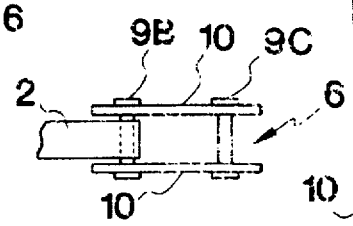
FIG. 3 shows a top view of the upper hinge mechanism.
Figure 4:
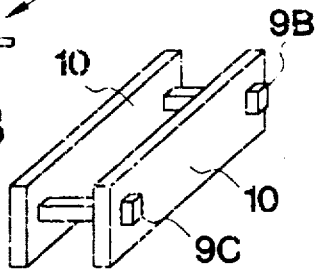
FIG. 4 shows a perspective view of the upper hinge mechanism.

FIG. 3 and FIG. 4 show the upper hinge mechanism 5 consisting of two parallel plates 10 oriented on opposite sides of the frame piece 2 and extending towards the hook piece 4. A bolt 9B, or other attachment means, runs through a hole in the width of the frame piece 2 thereby connecting the two parallel plates 10 at the end of the plates 10 nearest to the frame piece 2. At the end of the plates 10 towards the hook piece 4, a bolt 9C, or other attachment means, connects the plates 10 with the same separation distance as at the end joined near the frame piece 2.

Figure 5:
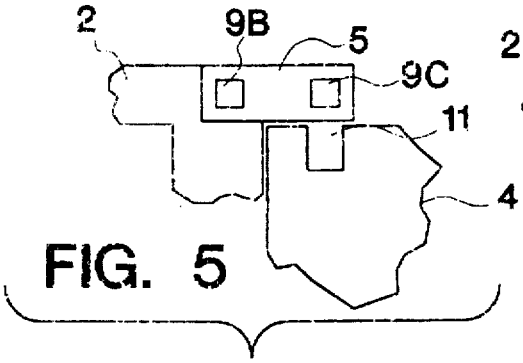
FIG. 5 shows a side view of the upper hinge mechanism and the notch in the hook piece.

FIG. 5 shows a notch 11 in the upper end of the hook piece 4 of a size slightly larger than the bolt 9C. The hook piece 4 can thus be connected to the upper hinge mechanism 5 when the bolt 9C is placed in the notch 11 by pivoting the upper hinge mechanism about the bolt 9B in the frame piece 2. When not thusly locked to the upper hinge 5, the hook piece 4 is free to pivot about the bolt 9A in the lower hinge mechanism 6.

Figure 6:
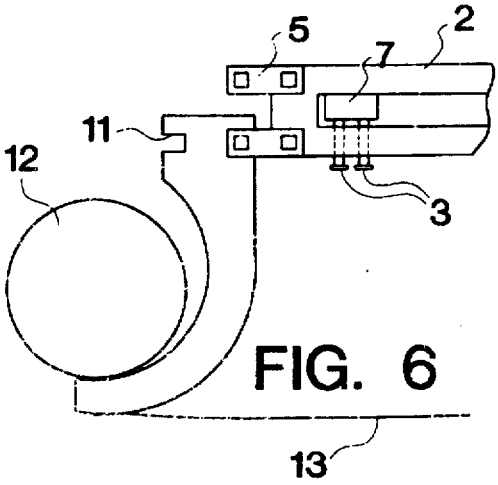
FIG. 6 shows a side view of the device in the loading/unloading position.

In use, a plurality of the apparatus are mounted on a fork lift as previously described, separated by a distance which is determined according to the length of the tines. FIG. 6 shows that to load an object 12, the upper hinge mechanism 5 is disconnected from the hook piece 4 so that the hook piece 4 freely rotates about the lower hinge 6, as previously described. The tines 7 of the fork lift are then lowered to allow the hook piece 4 to rotate to a position wherein the semi-circular region of the hook piece 4 contacts the ground 13 near its endpoint opposite the upper hinge 5, as shown in FIG. 6. A large cylindrical object 12 (or several smaller cylindrical objects) to be carried is then placed in the hook piece 4 either manually or by the maneuvering of the fork lift.

Figure 7:
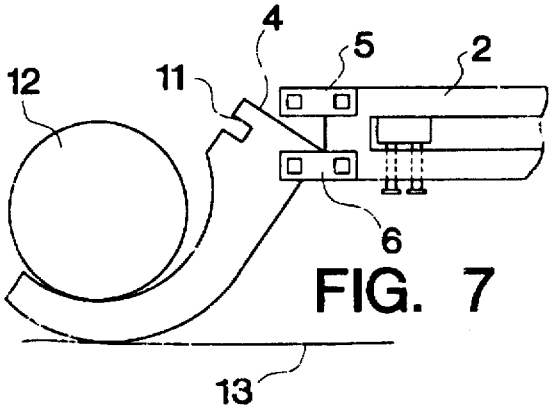
FIG. 7 shows a side view of the device in the process of loading/unloading.
Figure 8:
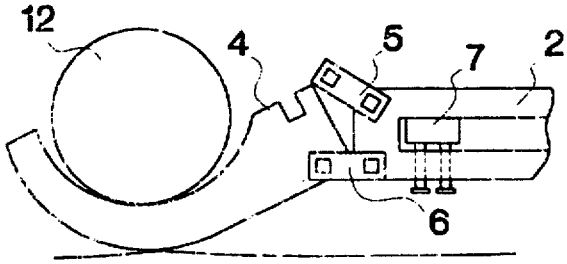
FIG. 8 shows a side view of the loaded device as it is being locked.
Figure 9:
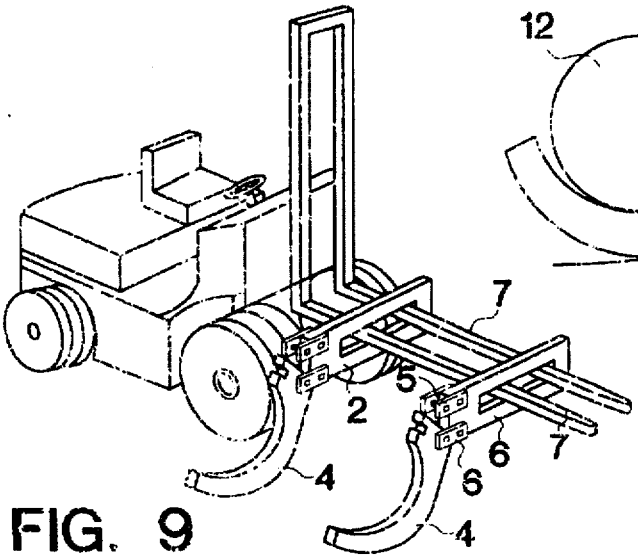
FIG. 9 shows a perspective view of the present invention attached to a fork lift.

FIG. 7 shows that as the tines 7 are further lowered, the point of contact between the ground 13 and the hook piece 4 moves along the outer rim of the hook piece 4, bringing the semi-circular region into an increasingly concave up condition by continued rotation about the lower hinge mechanism 6, thereby further securing the cylindrical object 12. FIG. 8 shows that as the tines 7 are lowered, the upper portion of hook piece 4 will move in the direction of the arrow shown in FIGS. 7, 8 until the bolt 9C on upper hinge mechanism 5 drops into slot 11. The weight of hook 4 and the object 12 will prevent the hook piece 4 from disengaging from upper hinge mechanism 5. Once the hook piece 4 is thusly locked, the tines 7 may be raised, thereby raising the cylindrical object 12. With the cylindrical object loaded beside the fork lift, the fork lift will be able to move through doorways that it could not pass through if the cylindrical object was positioned perpendicular to the longitudinal axis of the fork lift. Unloading of the object 12 is accomplished by reversing the process described herein for loading.

While the material selection and construction of the device and all components is not crucial to the functioning of the device, the material selection and construction may be selected to assure the proper functioning of the device and minimize costs. The best choice of material for the device is steel, though other objects which satisfy the requirements of the device would also be acceptable. The bolts 9A,9B,9C described herein are understood to be nut and bolt connections or any other device such as, but not limited, to pins with cotter keys, which are sufficiently strong and achieve the desired separations and connections described herein.

Although the fork lift attachment and the means of using the same according the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. An attachment apparatus for a fork lift device, having a pair of forward facing tines, which adapts the tines to carry cylindrical objects, said attachment apparatus comprising:

at least a pair of supports, each said support having a top, bottom and two sides, thereby forming an enclosure for receiving said tines, securing means for securing said tines to said at least a pair of supports by extending through the bottom of each said support for contacting the tines in the enclosure, at least a pair of hinge means attached to at least one of said sides, at least one holder having a semi-cylindrical portion for holding cylindrical objects, one of said pair of hinge means being attached at one end adjacent said bottom and at another end to a said at least one holder, another of said pair of hinge means being attached at one end adjacent said top and detachably secured at another end to said holder.

2. The attachment apparatus for a fork lift device as claimed in claim 1, wherein said at least a pair of hinge means comprises a pair of parallel plates, said plates being joined by at least a pair of fastening means which extend perpendicular to said plates.

3. The attachment apparatus for a fork lift device as claimed in claim 1, wherein said securing means is at least a pair of set screws.

4. The attachment apparatus for a fork lift device as claimed in claim 1, wherein said at least a pair of supports are parallel to each other, wherein each of said at least a pair of supports has a said holder attached thereto, each said semi-cylindrical portion having a bottom portion which is coextensive with said bottom of said support when said one of said hinge means is secured to said holder, each said semi-cylindrical portion having a top portion which is coextensive with said top of said support when said another of said hinge means is secured to said holder.

5. An attachment apparatus for a fork lift device which adapts the fork lift device to carry cylindrical objects in combination with a fork lift device, and wherein said fork lift device has a pair of forward facing lifting tines projecting from a front of said fork lift device, said tines having a length and a width with said length being parallel to a longitudinal axis of said fork lift device, and said attachment apparatus comprising:

at least a pair of supports, each said support having a top, bottom and two sides, thereby forming an enclosure for receiving said tines, securing means for securing said tines to said at least a pair of supports by extending through the bottom of each said support for contacting the tines in the enclosure, at least a pair of hinge means attached to at least one of said sides, at least one holder having a semi-cylindrical portion for holding cylindrical objects, one of said pair of hinge means being attached at one end adjacent said bottom and at another end to a said at least one holder, another of said pair of hinge means being attached at one end adjacent said top and detachably secured at another end to said holder, wherein said bottom and said top of said at least a pair of said supports extend perpendicular to said length of said tines.

6. The attachment apparatus for a fork lift device in combination with a fork lift device as claimed in claim 5, wherein said fork lift device has a front and a pair of sides, said holders, when attached to said tines, being positioned closer to one of said pair of sides of said fork lift device than to another of said sides of said fork lift device.

* * * * *